US008088497B2

(12) United States Patent
Hu et al.

(10) Patent No.: US 8,088,497 B2
(45) Date of Patent: Jan. 3, 2012

(54) HOUSING

(75) Inventors: Zong-Hua Hu, Shenzhen (CN); Hai-Bo Pan, Shenzhen (CN); Xu Li, Shenzhen (CN); Yi-Jun Huang, Shenzhen (CN); Chwan-Hwa Chiang, Taipei Hsien (TW); Feng-Yuen Dai, Taipei Hsien (TW)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 86 days.

(21) Appl. No.: 12/702,376

(22) Filed: Feb. 9, 2010

(65) Prior Publication Data

US 2010/0310899 A1 Dec. 9, 2010

(30) Foreign Application Priority Data

Jun. 3, 2009 (CN) ..... 2009 1 0302878

(51) Int. Cl.
*B32B 15/04* (2006.01)
*B32B 15/08* (2006.01)
*B32B 15/18* (2006.01)

(52) U.S. Cl. ..... 428/626; 428/650; 428/649; 428/666; 428/667; 428/685; 428/216; 428/220

(58) Field of Classification Search ..... 428/626, 428/650, 651, 653, 658, 649, 666, 667, 685, 428/215, 216, 220, 336, 457
See application file for complete search history.

(56) References Cited

U.S. PATENT DOCUMENTS 6,399,219 B1 * 6/2002 Welty et al. ..... 428/626
* cited by examiner

*Primary Examiner* — Michael Lavilla
(74) *Attorney, Agent, or Firm* — Altis Law Group, Inc.

(57) ABSTRACT

A method for making a housing comprises of providing a metal substrate; forming a base paint coating on the substrate; vacuum depositing a first metal coating on the base paint coating, the first metal coating being a chromium coating or a stainless steel coating; vacuum depositing a second metal coating on the first metal coating, the second metal coating being a commix metal coating containing chromium and stainless steel; and vacuum depositing a third metal coating on the second metal coating, the third metal coating being a stainless steel coating. A housing made by the above mentioned method is also described there.

6 Claims, 1 Drawing Sheet

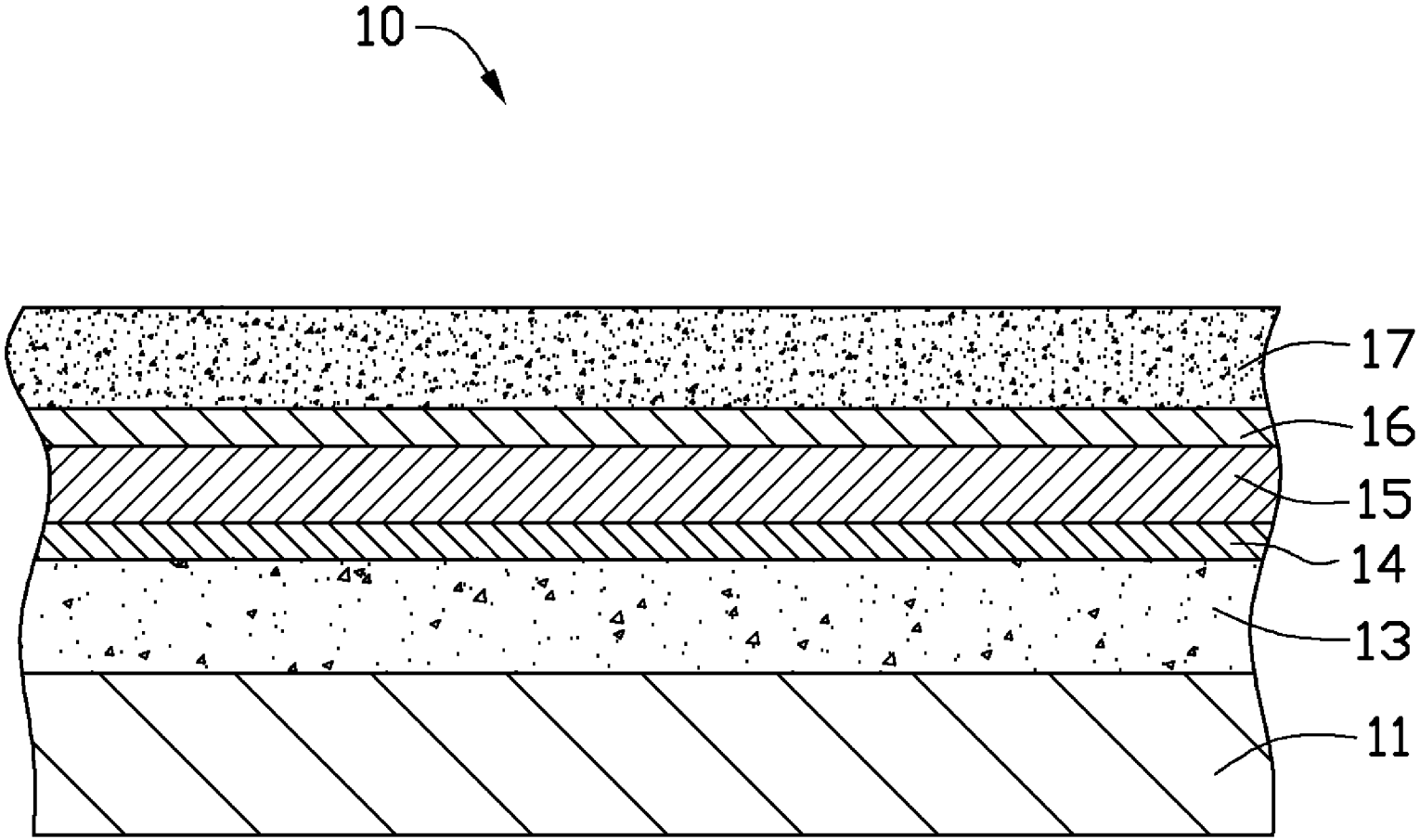
10
17
16
15
14
13
11

HOUSING

BACKGROUND

1. Technical Field

The present disclosure relates to methods for making housings, especially to a method for making housing having a stainless steel appearance and housing thereof.

2. Description of Related Art

Magnesium and magnesium alloys are widely used for manufacturing housings of portable electronic devices. However, magnesium and magnesium alloys are prone to corrosion such as galvanic corrosion and therefore, should be surface treated before being used. A typically used surface treatment magnesium and magnesium alloys is vacuum deposition. After vacuum deposition, the corrosion resistance and the metallic appearance of the magnesium and magnesium alloys may be greatly improved. However, there are some difficulties for vacuum depositing on the magnesium and magnesium alloys because magnesium and its alloys are highly chemically active and often have rough surfaces which weakly bond with the deposited coatings.

Therefore, there is room for improvement within the art.

BRIEF DESCRIPTION OF THE FIGURE

Many aspects of the housing can be better understood with reference to the following FIGURE. The components in the FIGURE are not necessarily drawn to scale, the emphasis instead being placed upon clearly illustrating the principles of the housing.

The FIGURE is a cross-section view of an exemplary embodiment of a housing.

DETAILED DESCRIPTION

A method for making a housing, may comprise providing a metal substrate; forming a base paint coating on the substrate; vacuum depositing a first metal coating on the base paint coating, the first metal coating being a chromium coating or a stainless steel coating; vacuum depositing a second metal coating on the first metal coating, the second metal coating being a commix metal coating containing chromium and stainless steel; and vacuum depositing a third metal coating on the second metal coating, the third metal coating being a stainless steel coating.

Referring to the FIGURE, a metal substrate 11 is provided. The substrate 11 may be made of magnesium or magnesium alloy. The substrate 11 can be a housing of a mobile phone, a digital camera, a personal digital assistant, or a note-book computer. The substrate 11 may also be a housing of a container.

The substrate 11 is pretreated. The pre-treating step may comprise chemical cleaning and bonderizing the substrate 11. The chemical cleaning process may be carried out by dipping the substrate 11 in an inorganic acid solution for several minutes. The inorganic acid solution may be hydrochloric acid solution or sulfuric acid solution. After the cleaning process, the substrate 11 is sequentially bathed in water. The bonderizing process may be carried out by dipping the substrate 11 in a solution containing phosphoric acid or phosphate. On the surface of the substrate 11, a metallic oxide film having low chemical activity will form during the bonderizing process. The film allows more reliable bonding of paint coating or metal coating thereon. After bonderizing, the substrate 11 is bathed again in water and then dried.

A base paint coating 13 is then sprayed on the substrate 11. The base paint coating 13 can be a single ultraviolet (UV) curing paint coating having a thickness of about 55-65 μm. The base paint coating 13 can also include a first base paint coating having a thickness of about 35-40 μm formed on the substrate 11 by spraying polyurethane paint and a second base paint coating having a thickness of about 20-25 μm formed on the first base paint coating by spraying UV paint. The base paint coating 13 may be white or transparent, and have a smooth surface that enhance the bonding between the substrate 11 and subsequently formed coatings.

A first metal coating 14 is applied on the base paint coating 13 by vacuum deposition. The first metal coating 14 may be a chromium coating or a stainless steel coating having a thickness of about 45-55 nm. Vacuum deposition of the first metal coating 14 may be carried out in a chamber by using multi-arc ion plating for about 30-60 seconds at about 20° C., using about 55-60 KW of power. The chamber is infused with inert argon gas. During the deposition process, the pressure in the chamber is maintained at about 0.4-0.6 Pa.

A second metal coating 15 is applied on the first metal coating 14 by vacuum deposition. The second metal coating 15 is a commix metal coating containing chromium and stainless steel. The second metal coating 15 has a thickness of about 180-220 nm. The content of chromium in the second metal coating 15 may be about 30% by weight. Vacuum deposition of the second metal coating 15 may be carried out in the chamber by depositing chromium and stainless steel on the first metal coating 14 at the same time. Depositing the chromium may be carried out by using multi-arc ion plating for about 90-180 seconds at about 20° C., using about 55-60 KW of power. Depositing the stainless steel may be carried out by using dc-diode sputtering for about 90-180 seconds at about 20° C., using about 15-18 KW of power. The chamber is infused with inert argon gas. During the deposition process, the pressure in the chamber is maintained at about 0.4-0.6 Pa.

A third metal coating 16 is applied on the second metal coating 15 by vacuum deposition. The third metal coating 16 may be a stainless steel coating has a thickness of about 15-25 nm. Vacuum deposition of the third metal coating 16 may be carried out in the chamber by using dc-diode sputtering for about 15 seconds at about 20° C., using about 15-18 KW of power. The chamber is infused with inert argon gas. During the deposition process, the pressure in the chamber is maintained at about 0.4-0.6 Pa.

An optional top paint coating 17 may be applied on the third metal coating 16 by spraying paint. The top paint coating 17 can be transparent and have a thickness of about 20-25 μm. The paint used for spraying the top paint coating 17 can be polyurethane paint. The top paint coating 17 can protect the third metal coating 16 from being abrasion.

It should be understood, the substrate 11 can also be made of aluminum, aluminum alloy or zinc alloy.

Referring to the FIGURE, a housing 10 made by the above mentioned method includes a metal substrate 11, and a base paint coating 13, a first metal coating 14, a second metal coating 15, a third metal coating 16, a top paint coating 17 formed on the substrate 11 in order. The substrate 11 can be made of magnesium, magnesium alloy, aluminum, aluminum alloy or zinc alloy. The base paint coating 13 may be a single UV paint coating having a thickness of about 55-65 μm, or a coating including a first polyurethane base paint coating having a thickness of about 35-40 μm formed on the substrate 11 and a second UV base paint coating having a thickness of about 20-25 μm formed on the first base paint coating. The first metal coating 14 may be a chromium coating or a stainless steel coating. The second metal coating 15 may be a commix metal coating containing chromium and stainless steel. The third metal coating 16 may be a stainless steel coating. The top paint coating 17 is a transparent polyurethane paint coating.

The exemplary method for making the housing 10 by forming a base paint coating 13 having a smooth surface on the substrate 11 to enhance the bonding between the substrate 11 and the metal coatings 14-16; and further by controlling the technical condition of depositing the metal coatings 14-16 to make the housing 10 present an aesthetic stainless steel appearance.

It is believed that the present embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. A housing, comprising:

a metal substrate; and a base paint coating formed on the substrate, a first metal coating formed on the base paint coating, a second metal coating formed on the first metal coating, a third metal coating formed on the second metal coating;

wherein the first metal coating is a chromium coating or a stainless steel coating; the second metal coating is a commix metal coating comprising chromium and stainless steel constituents; the third metal coating is a stainless steel coating.

2. The housing as claimed in claim 1, wherein the substrate is made of magnesium, magnesium alloy, aluminum, aluminum alloy or zinc alloy.

3. The housing as claimed in claim 1, wherein the base paint coating is an ultraviolet curing paint coating having a thickness of about 55-65 μm.

4. The housing as claimed in claim 1, wherein the first metal coating has a thickness of about 45-55 nm, the second metal coating has a thickness of about 180-220 nm, and the third metal coating has a thickness of about 15-25 nm.

5. The housing as claimed in claim 1, wherein the chromium has a content of about 30 wt % with regard to the chromium and stainless steel in the second metal coating.

6. The housing as claimed in claim 1, wherein the housing further comprises a transparent top paint coating formed on the third metal coating.

* * * * *